US007755559B2

(12) United States Patent
Pakosz et al.

(10) Patent No.: US 7,755,559 B2
(45) Date of Patent: Jul. 13, 2010

(54) DUAL-BAND OMNIDIRECTIONAL ANTENNA

(75) Inventors: Daniel Pakosz, Elgin, IL (US); Randy Posluszny, Brookfield, IL (US); Clifford Raiman, Roselle, IL (US)

(73) Assignee: Mobile Mark, Inc., Schiller Park, IL (US)

( * ) Notice: Subject to any disclaimer, the term of this patent is extended or adjusted under 35 U.S.C. 154(b) by 0 days.

(21) Appl. No.: 12/482,001

(22) Filed: Jun. 10, 2009

(65) Prior Publication Data

US 2010/0141545 A1 Jun. 10, 2010

Related U.S. Application Data

(60) Provisional application No. 61/120,894, filed on Dec. 9, 2008.

(51) Int. Cl.
*H01Q 21/00* (2006.01)

(52) U.S. Cl. ..... 343/810; 343/793; 343/700 MS

(58) Field of Classification Search ..... 343/810, 343/793, 700 MS
See application file for complete search history.

(56) References Cited

U.S. PATENT DOCUMENTS 7,064,729 B2 6/2006 Olson
7,292,200 B2 11/2007 Posluszny et al.
7,369,094 B2 * 5/2008 Song et al. ..... 343/816

* cited by examiner

*Primary Examiner*—Douglas W Owens
*Assistant Examiner*—Dieu Hien T Duong
(74) *Attorney, Agent, or Firm*—George H. Gerstman; Seyfarth Shaw LLP

(57) ABSTRACT

A dual-band omnidirectional antenna is provided. The antenna comprises a vertically stacked antenna array, in the following order: a first dual-band dipole which resonates at a first frequency band and a second frequency band, a first single-band dipole which resonates only at the first frequency band, a second single-band dipole which resonates only at the first frequency band, and a second dual band dipole which resonates at the first frequency band and second frequency band. The first frequency band is of a higher frequency than the second frequency band.

12 Claims, 4 Drawing Sheets

DUAL-BAND OMNIDIRECTIONAL ANTENNA

This application claims the benefit of priority to provisional application No. 61/120,894 filed Dec. 9, 2008 and incorporates herein the disclosure of the provisional application.

FIELD OF THE INVENTION

The present invention is in the field of dual-band omnidirectional antennas in which performance is optimized.

BACKGROUND OF THE INVENTION

Dual-band omnidirectional antennas play an important role in various wireless communication systems, particularly point to multipoint cellular infrastructure networks. Certain prior art dual-band omnidirectional antennas are tall in length and constructed of two vertically stacked antennas in the same radome with each antenna being fed independently. Other prior art dual-band antennas are tall in length and composed of two individually stacked antenna arrays within the same radome, combined by a single feed. In the latter, two individual antenna feeds are attached to a combiner either in the center of the antenna or at the bottom of the antenna, creating losses. Further, the antenna pattern is distorted by the contributions of the second antenna or the combiner itself. Other prior art dual-band omnidirectional antennas are located aside each other, whether in the same radome or independent, but generally result in distorted radiation patterns. This is due to interference with each other and as a result there is an effect on both elevation and azimuth radiation patterns. In addition, some prior art dual-band antennas use a multitude of stacked printed circuit boards adjacent each other, with each having an independent function. The stacked printed circuit boards are generally combined by means of a di-plexer.

It is an object of the present invention to alleviate the losses and the distorted radiation patterns that are found in prior art dual-band omnidirectional antennas.

SUMMARY OF THE INVENTION

In accordance with the present invention, a dual-band omnidirectional antenna is provided. The antenna comprises a vertically stacked antenna array. The antenna array comprises, in order in the stack, a first dual-band dipole which resonates at a first frequency band and a second frequency band, a first single-band dipole which resonates only at the first frequency band, a second single-band dipole which resonates only at the first frequency band, and a second dual-band dipole which resonates at the first frequency band and the second frequency band. The first frequency band is of a higher frequency than the second frequency band.

In the illustrative embodiment, there is a feed point for a transmission line between the first single-band dipole and the second single-band dipole. The feed point is off-centered between the first single-band dipole and the second single-band dipole.

In the illustrative embodiment, the first dual-band dipole and the first single-band dipole combination have an impedance and phase shift that is different from the second single-band dipole and the second dual-band dipole combination.

In the illustrative embodiment, the antenna array includes a printed circuit board carrying the dipoles. The antenna array is housed within a radome having a cap and a base. The radome has a top cap and is supported by a base, and includes a coaxial feed extending upward from the base.

In the illustrative embodiment, the dual-band dipoles are series fed and as a combination with the single-band dipoles are corporate fed. The dual-band dipoles are capacitively coupled and the single-band dipoles have DC shorts.

A more detailed explanation of the invention is provided in the following description and claims, and is illustrated in the accompanying drawings.

DETAILED DESCRIPTION OF THE ILLUSTRATIVE EMBODIMENT

In the present invention, an elongated circuit board is used. The circuit board has dual-band dipoles at opposite ends and between the dual-band dipoles there are two single-band dipoles. In the illustrative embodiment, the dual-band dipoles resonate at around 1900 megahertz and around 850 megahertz. The single-band dipoles that are interposed between the spaced dual-band dipoles are for resonating at the higher frequencies only, around 1900 megahertz. The single band elements that are between the dual-band elements look like tuning or matching components for the low frequency, although, as stated above, they actually are meant to resonate at the high frequency. The feed is intermediate the two single-band dipoles but it is not necessarily centered between the two.

Thus the present invention concerns a vertical antenna in which there are two separated dual-band dipoles, and intermediate of those two separated dual-band dipoles there are two single-band dipoles. Each of the single-band dipoles resonates at the high-band of the dual-band dipoles.

Figure 1:
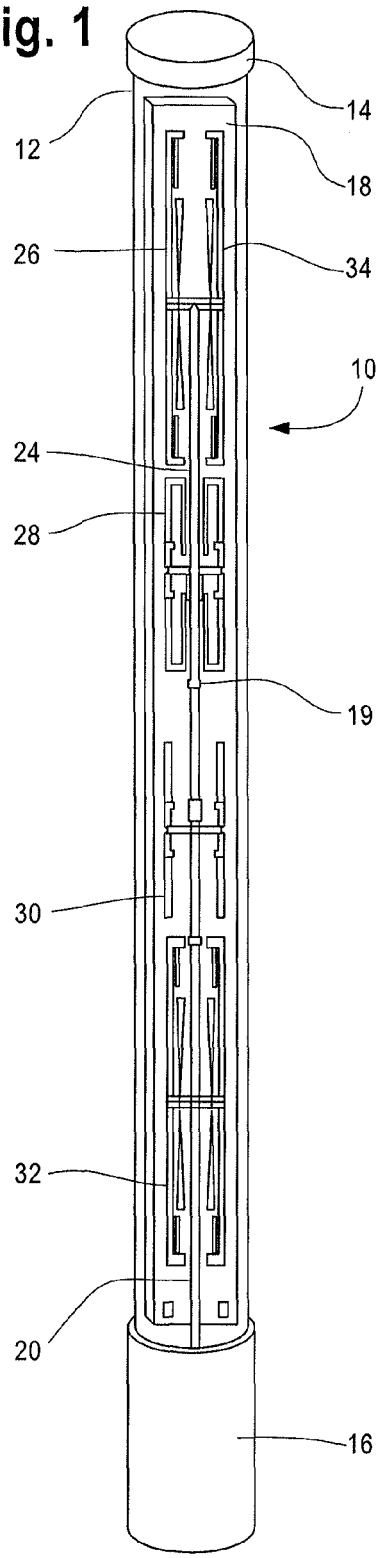
FIG. 1 is a front elevation of a dual-band omnidirectional antenna constructed in accordance with the principles of the present invention.

Referring to FIG. 1, dual-band omnidirectional antenna 10 includes a radome 12, a radome top cap 14, and an antenna base 16. A single printed circuit board 18 is centered within the radome and is fed off-center (feed point) 19 of the printed circuit board 18 by means of a coaxial transmission line 20. The transmission line 20 is a coaxial feed which continues upward from the base 16 to the printed circuit board input 19. The feed travels along the ground side 24 of the linear dipole array which is located on the single printed circuit board 18.

On the printed circuit board 18, there are four radiating elements 26, 28, 30 and 32 which are vertically stacked. The two outward radiating elements 26 and 32 are dual-band dipoles which resonate at both low frequency and high frequency bands and the two inner radiating 28 and 30 elements are single-band dipoles which resonate only at the high frequency band.

The spacing 33 between the two outward elements 26 and 32 is slightly less than one wavelength at the mid-portion of the low frequency band and approximately 1.8 wavelength at the mid-portion of the high frequency band. The inner two radiating elements 28 and 30 resonate at the high frequency band and appear as one-quarter wavelength electrical shorts to the low frequency band. Thus the effect from the two inner elements 28 and 30 to the elevation and azimuth radiation patterns of the low frequency band are mitigated out, while at the high frequency band all four elements 26, 28, 30 and 32 radiate and resonate for operation without distortion.

In the illustrative embodiment, the phase contributions of each half of the linear array emanating from the feed point 19 are electrically different. This eliminates the incoherent phase effects commonly found in prior art linear arrays where the "element shapes" and spacing between are ordinarily the same, including but not limited to uniform and tapered linear arrays. Typically these phase errors in prior art arrays add up destructively to the performance of operation, affecting the VSWR, azimuth and elevation radiation patterns.

Figure 6:
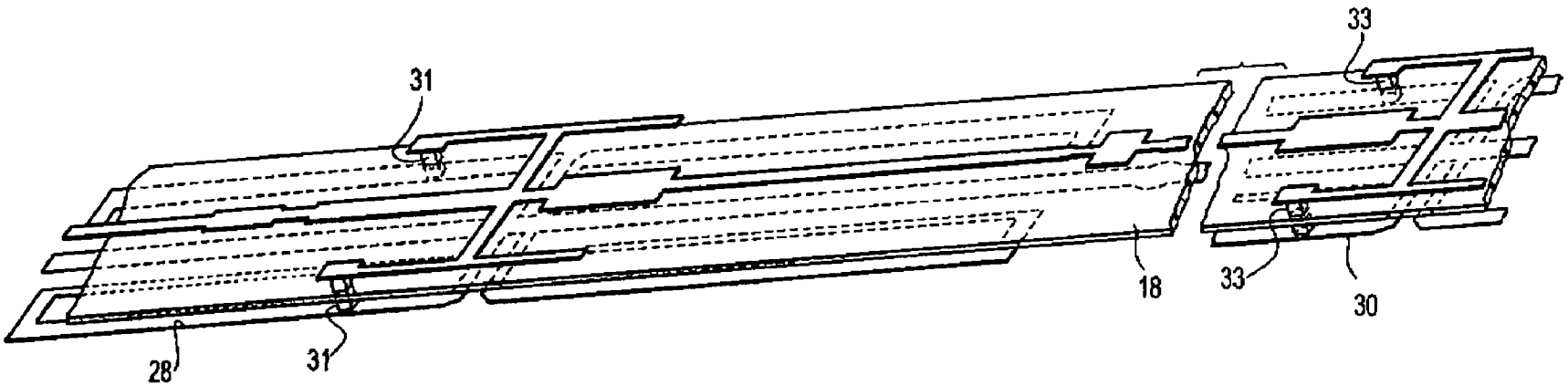
FIG. 6 is a top perspective view, partially broken, of the middle two elements of the array of FIG. 1.

By contrast, in the present invention the phase contributions from each half of the linear array add up coherently and allow for operation without distortion. Referring to FIG. 6, the high frequency band utilizes the inner two single-band dipoles 28 and 30 in the array that have DC shorts 31 and 33 at each element. The DC shorts 31 and 33 are connection points passing through the substrate 18, making electrical contact between the top conductive surface placed upon the substrate 18 and the bottom conductive surface placed upon the other side of the substrate. The outer two radiating elements 26 and 32, the dual-band dipoles, are capacitively coupled, but do not require DC shorts at each element in the array or a combination that allows for the same performance of operation. Thus the elevation and azimuth radiation pattern for each band of operation maintains performance without distortion, allowing for a good VSWR of 2 or better when used in this manner.

Each of the outer dual-band dipoles 26 and 32 in the array is series fed and as combined with the two inner single-band dipoles 28 and 30 is corporate fed. In this manner, the inner single-band dipole 28 infused with the outer dual-band dipole 26 (the top two elements 30 and 32 in the array) allow for an impedance and phase shift different from the other side of the array (the bottom two elements in the array).

The present invention minimizes the influence of the high frequency band on the low frequency band and vice versa. In this manner, the radiation pattern for each band of operation maintains performance without distortion. As stated above, as an example although no limitation is intended, a cellular infrastructure network may utilize the frequency bands centered around 850 megahertz and 1900 megahertz. However, the present invention is also scalable to other frequency bands of operation including those for WIMAX, ISM, UNI, and others.

The invention allows for dual-band operation without distortion or compromising the radiation pattern performance (both elevation and azimuth) or VSWR performance of each band of operation from a single substrate covered on both sides with conductive material. The conductive material can be copper but it is not limited to conductive films or other conducting substances deposited on or bonded to the substrate. PCB 18 is preferably centered within radome 12, but may be off-center for variance of mechanical or electrical performance.

FIG. 1 thus shows a broad band dual-band omnidirectional antenna of a non-uniform linear element array spaced arbitrarily along the length of a single substrate covered on both sides with a conductive material 34, and housed within a radome enclosure 12 while being supported by a base 16.

Figure 2:
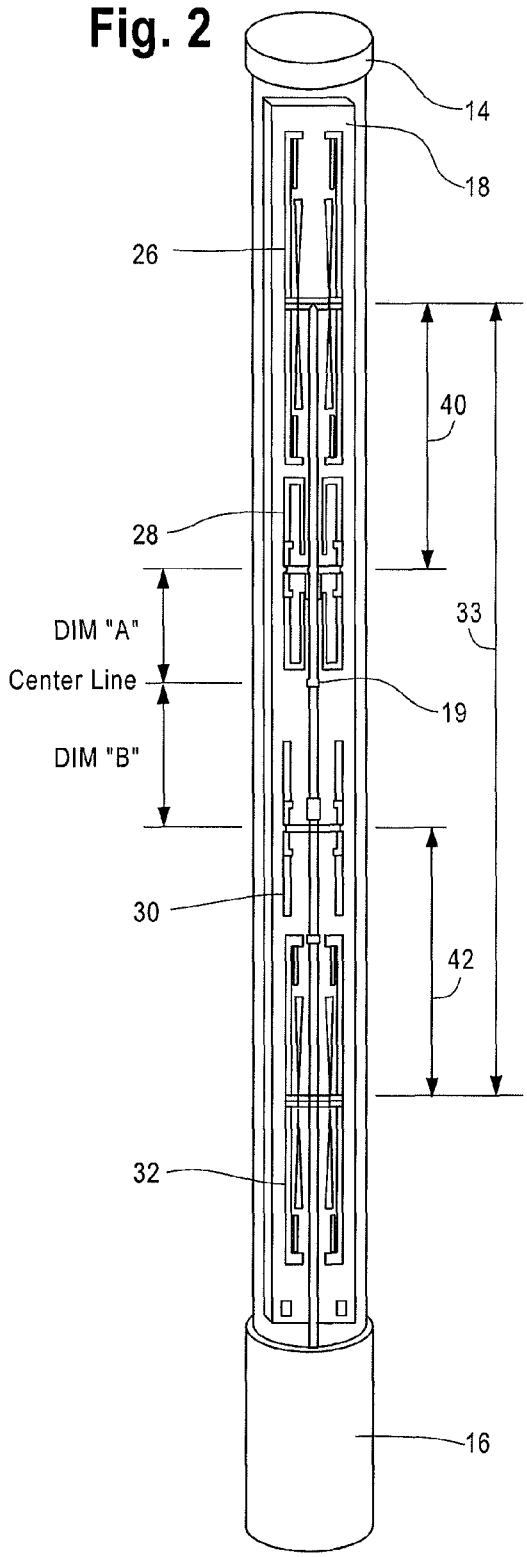
FIG. 2 is a dimensional view of the antenna of FIG. 1.

Referring to FIG. 2, feed point 19 is off-center between the two inner radiating elements 28 and 30. The two outward radiating elements 26 and 32 resonate at both low frequency and high frequency bands. The spacing between the two outward radiating elements 26 and 32 is slightly under one wavelength at the mid portion of the lower frequency band and approximately 1.8 wavelength at the mid portion of the high frequency band.

The inner two radiating elements 28 and 30 are arbitrarily spaced in the array depicted from the centerline CL as referenced Dim A and Dim B. Radiating elements 28 and 30 appear as ¼ wavelength electrical shorts to the lower frequency band radiating outer elements 26 and 32 shown in combination as 40 and 42.

Referring to FIG. 2, each outer element 26 and 32 in the array is series fed and as a combination with the two inner elements 28 and 30 is corporate fed. The inner two elements 28 and 30 have dc shorts 44 and the outer two radiating elements are capacitively coupled.

Figure 3:
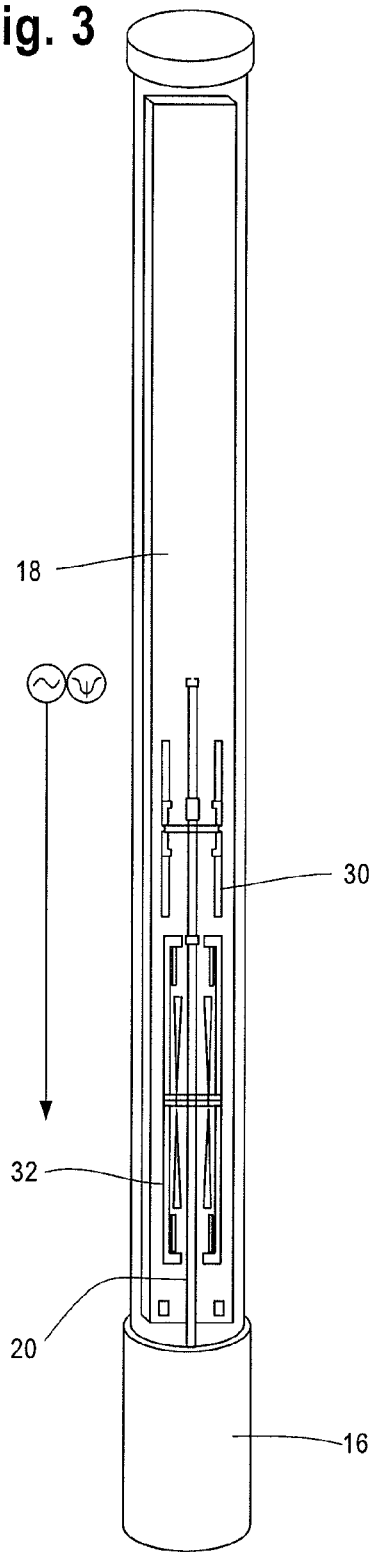
FIG. 3 is a diagrammatic view of the bottom two elements of the array of FIG. 1.
Figure 4:
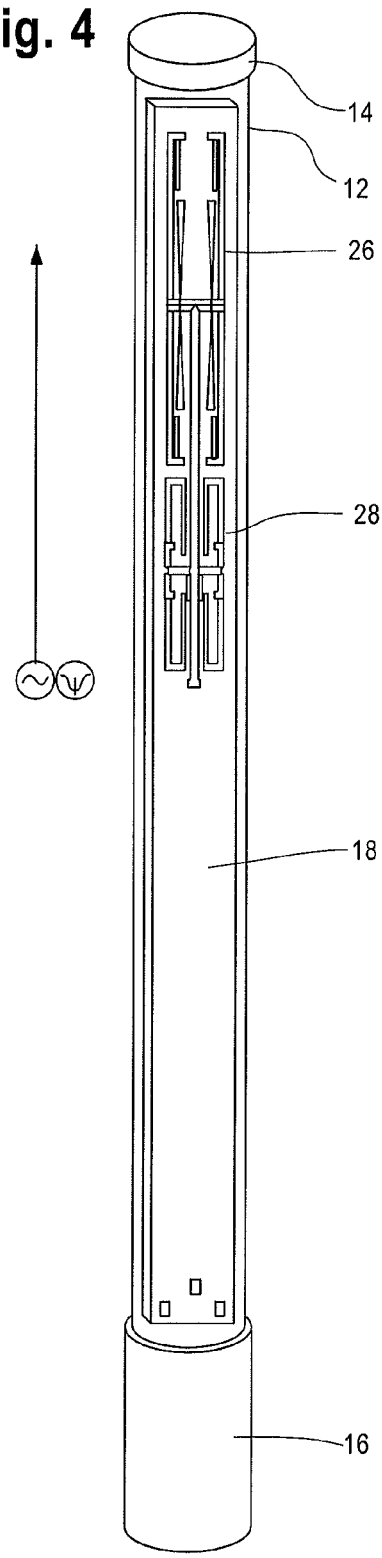
FIG. 4 is a diagrammatic view of the upper two elements of FIG. 1.

FIG. 3 is a diagrammatic view of the bottom two elements 30 and 32 of the array of FIG. 1 and FIG. 4 is a diagrammatic view of the upper two elements 26 and 28 of FIG. 1. The difference in one of the inner radiating elements in series with the outer radiating element allows for an impedance and phase shift different from the other side of the array, seen as (the bottom two elements in the array). When combined and fed by the coaxial cable 20 off center of the four element dipole array, the phase contributions look different from each ½ of the array, thus mitigating the incoherent phase effects of the four element linear array.

Figure 5:
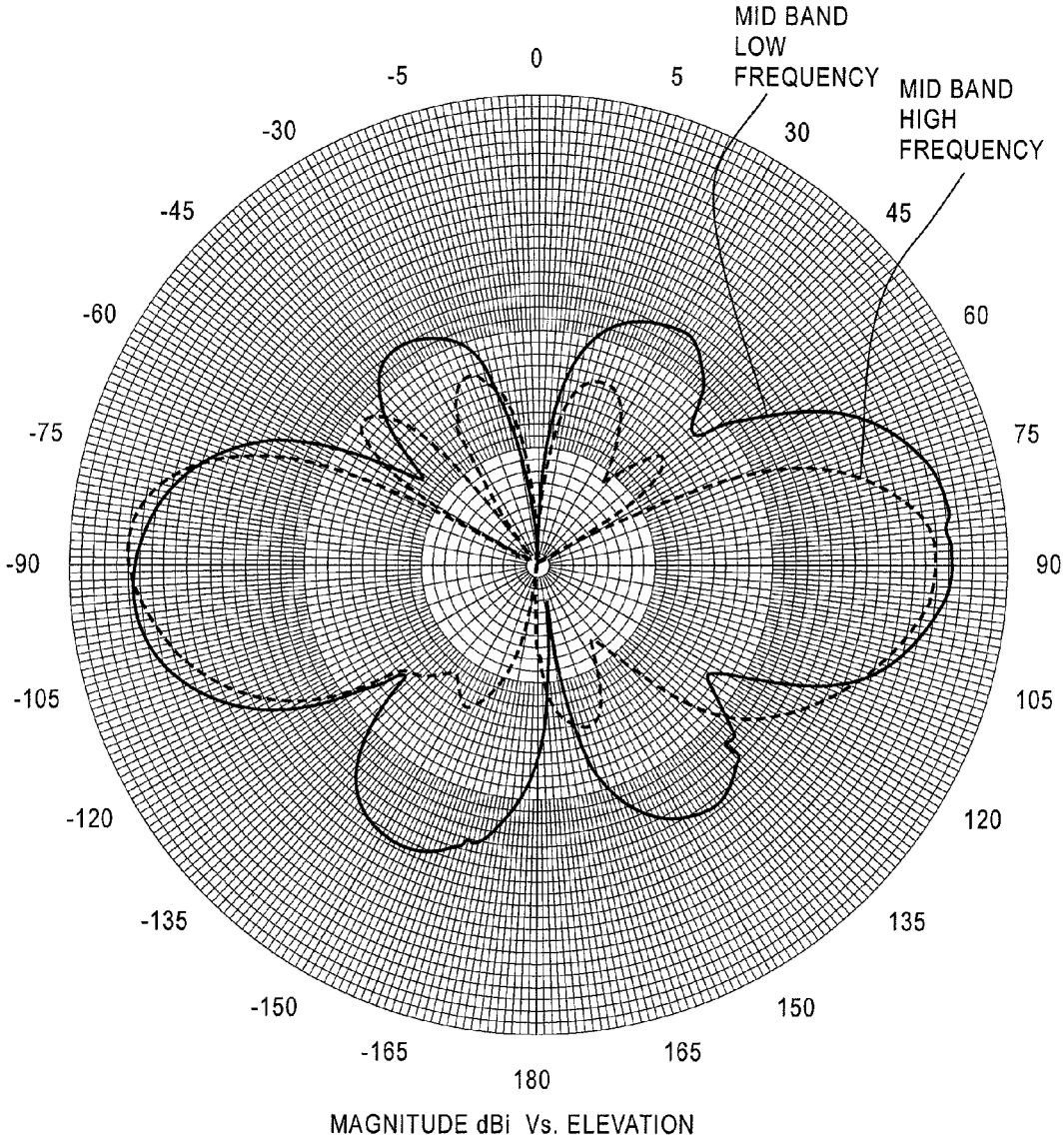
FIG. 5 is a elevation and azimuth radiation pattern for the antenna of FIG. 1.

Referring to FIG. 5, the elevation and azimuth radiation pattern for each band of operation maintains performance without distortion. The example of FIG. 5 illustrates the elevation and radiation pattern of the mid band of the lower frequency of operation (850 megahertz) and mid band of the high frequency of operation (1900 megahertz).

Although an illustrative embodiment of the invention has been shown and described, it is to be understood that the various modifications and substitutions may be made without departing from the novel spirit and scope of the present invention.

That which is claimed:

1. A dual-band omnidirectional antenna which comprises:

a vertically stacked antenna array comprising, in order in the stack, a first dual-band dipole which resonates at a first frequency band and a second frequency band, a first single-band dipole which resonates only at the first frequency band, a second single-band dipole which resonates only at the first frequency band, and a second dual-band dipole, which resonates at the first frequency band and the second frequency band;

the first frequency band being of a higher frequency that the second frequency band; a feed point for a transmission line located between the first single-band dipole and the second single-band dipole; and said single-band dipoles having DC shorts; the first single-band dipole and the second single-band dipole are non-symmetrical from the feed point whereby the phase contributions of the first dual-band dipole and the first single-band dipole are different from the phase contributions of the second single-band dipole and the second dual-band dipole.

2. A dual-band omnidirectional antenna as defined by claim 1, in which the feed point is off-centered between the first single-band dipole and the second single-band dipole.

3. A dual-band omnidirectional antenna as defined by claim 1, in which the first dual-band dipole and the first single-band dipole combination having an impedance and phase shift that is different from the second single-band dipole and the second dual-band dipole combination.

4. A dual-band omnidirectional antenna as defined by claim 1, in which the antenna array includes a printed circuit board having a substrate carrying the dipoles, said substrate having a top conductive surface and a bottom conductive surface, said DC shorts comprising connection points passing through the substrate and making contact between the top conductive surface and the bottom conductive surface.

5. A dual-band omnidirectional antenna as defined by claim 4, in which the antenna array is housed within a radome having a cap and a base.

6. A dual-band omnidirectional antenna as defined by claim 5, in which the radome has a top cap and is supported by a base; and including a coaxial feed extending upward from the base.

7. A dual-band omnidirectional antenna as defined by claim 1, in which the dual-band dipoles are series fed and as a combination with the single-band dipoles are corporate fed.

8. A dual-band omnidirectional antenna which comprises:

a vertically stacked antenna array comprising, in order in the stack, a first dual-band dipole which resonates at a first frequency band and a second frequency band, a first single-band dipole which resonates only at the first frequency band, a second single-band dipole which resonates only at the first frequency band, and a second dual-band dipole which resonates at the first frequency band and the second frequency band;

the first frequency band being of a higher frequency than the second frequency band;

a feed point for a transmission line between the first single-band dipole and the second single-band dipole;

said dual-band dipole being series fed and as a combination with a single-band dipole being corporate fed;

the single-band dipoles having DC shorts; the first single-band dipole and the second single-band dipole are non-symmetrical from the feed point whereby the phase contributions of the first dual-band dipole and the first single-band dipole are different from the phase contributions of the second single-band dipole and the second dual-band dipole.

9. A dual-band omnidirectional antenna as defined by claim 8, in which the feed point is off-centered between the first single band dipole and the second single-band dipole and in which the first dual-band dipole and the first single-band dipole combination having an impedance and phase shifts that is different from the second single-band dipole and the second dual-band dipole combination.

10. A dual-band omnidirectional antenna as defined by claim 8, the antenna array including a printed circuit board carrying the dipoles, and in which the antenna array is housed within a radome having a cap and a base.

11. A dual-band omnidirectional antenna as defined by claim 10 in which the radome has a top cap and is supported by a base; and including a coaxial feed extending upward from the base.

12. A dual-band omnidirectional antenna as defined by claim 8, in which the antenna array includes a printed circuit board having a substrate carrying the dipoles, said substrate having a top conductive surface and a bottom conductive surface, said DC shorts comprising connection points passing through the substrate and making contact between the top conductive surface and the bottom conductive surface.

* * * * *